United States Patent [19]

Parlman

[11] 4,316,797

[45] Feb. 23, 1982

[54] FLOTATION AGENT AND PROCESS

[75] Inventor: Robert M. Parlman, Bartlesville, Okla.

[73] Assignee: Phillips Petroleum Company, Bartlesville, Okla.

[21] Appl. No.: 185,711

[22] Filed: Sep. 10, 1980

[51] Int. Cl.[3] ..... B03D 1/02

[52] U.S. Cl. ..... 209/166; 252/45; 252/61

[58] Field of Search ..... 209/166, 167; 252/45, 252/161; 260/455

[56] References Cited

U.S. PATENT DOCUMENTS

| | | | |
|---|---|---|---|
| 1,577,328 | 3/1926 | Lewis | 209/167 |
| 1,628,151 | 5/1927 | Keller | 209/166 |
| 1,659,396 | 2/1928 | Douglass | 209/166 |
| 2,011,176 | 8/1935 | Keller | 209/166 |
| 2,020,021 | 11/1935 | Farrington | 252/45 |
| 2,110,281 | 3/1938 | Adams | 252/45 |
| 2,162,495 | 6/1939 | Trotter | 209/166 |
| 2,203,740 | 6/1940 | Ott | 209/166 |
| 2,498,863 | 2/1950 | Badertscher | 252/45 |
| 2,574,457 | 11/1951 | Arnold | 260/607 |
| 2,600,737 | 6/1952 | Crouch | 260/455 |
| 2,634,291 | 4/1953 | Arnold | 260/455 |
| 2,944,666 | 7/1960 | Bunge | 209/5 |
| 3,351,193 | 11/1967 | Martinez | 209/3 |
| 3,414,128 | 12/1968 | Baarson | 209/167 |
| 3,785,488 | 1/1974 | Werneke | 209/167 |
| 4,022,686 | 7/1977 | Arakatsu | 209/166 |
| 4,220,524 | 9/1980 | Poblete | 209/166 |

OTHER PUBLICATIONS

Chem. Abst., vol. 22, 1319.

*Primary Examiner*—Robert Halper

[57] ABSTRACT

A flotation agent comprising both an aromatic hydrocarbon oil and a dihydrocarbyl trithiocarbonate improves the collecting and separating efficiency of an ore froth flotation process as compared to using any one of the ingredients of the flotation agent alone. The flotation agent and process are particularly useful for the recovery of molybdenum minerals.

8 Claims, No Drawings

FLOTATION AGENT AND PROCESS

BACKGROUND OF THE INVENTION

Froth flotation is a process for concentrating minerals from ores. In a froth flotation process, the ore is crushed and wet ground to obtain a pulp. Additives such as mineral flotation or collecting agents, frothing agents, suppressants, stabilizers, etc., are added to the pulp to assist separating valuable minerals from the undesired or gangue portion of the ore in subsequent flotation steps. The pulp is then aerated to produce a froth at the surface. The froth containing the minerals which adhere to the bubbles is skimmed or otherwise removed and collected and further processed to obtain the desired minerals. Typical mineral flotation collectors include xanthates, amines, alkyl sulfates, arene sulfonates, dithiocarbamates, dithiophosphates and thiols.

Trithiocarbonates have also been described to be effective ore flotation agents, see for example, Chemical Abstracts, Vol. 22, 1319. U.S. Pat. No. 1,659,396 discloses the use of S,S'-diethyltrithiocarbonate as a copper ore flotation agent in a froth flotation process. U.S. Pat. No. 4,022,686 describes the use of kerosene, light oils and petroleum lubricants as promoters in a copper ore froth flotation process wherein xanthates, mercaptans and such type compounds are used as collectors. U.S. Pat. No. 3,351,193 discloses a process of separating molybdenum sulfide from other sulfide ores by froth flotation using a metal cyanide and a hydrocarbon fuel oil with or without a frother.

It is desirable in the minerals recovery technology to have collector systems available in a froth flotation process which are highly efficient and which are highly selective to a specific mineral.

THE INVENTION

It is thus one object of this invention to provide a collector system for a froth flotation process.

Another object of this invention is to provide a flotation agent which does not require the presence of added metal salts.

A still further object of this invention is to provide a collector system for a flotation agent which is specifically effective for molybdenum recovery.

A still further object of this invention is to provide a froth flotation process for collecting ores.

Still a further object of this invention is to provide a froth flotation process particularly useful for the flotation and recovery of copper and molybdenum ores, and more specifically of sulfide containing ores of copper and/or molybdenum.

In accordance with this invention is has now been found that a composition comprising an aromatic hydrocarbon oil and a dihydrocarbyl trithiocarbonate can be used as a flotation agent achieving a synergistic collecting efficiency as compared to the use of a comparable quantity of only one of the ingredients. More specifically, it has been found that using a mixture of the aromatic hydrocarbon oil and the dihydrocarbyl trithiocarbonate does not result in a collecting efficiency of this combined agent which is between the collecting efficiency of the aromatic oil and that of the dihydrocarbyl trithiocarbonate, but rather significantly exceeds both in collecting efficiencies.

Thus, in accordance with a first embodiment of this invention, there is provided a new composition of matter comprising an aromatic hydrocarbon oil and a dihydrocarbyl trithiocarbonate. More specifically, the dihydrocarbyl trithiocarbonate can be characterized by the formula

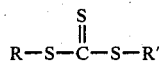

wherein R and R' are hydrocarbyl radicals having from 1 to 20 carbon atoms, preferably having 1 to 8 carbon atoms; and R and R' can be the same or different radicals. Examples of these type compounds are, for example S,S'-dimethyl trithiocarbonate
S,S'-diethyl trithiocarbonate
S,S'-didodecyl trithiocarbonate
S,S'-dieicosyl trithiocarbonate
S-ethyl-S'-methyl trithiocarbonate
S-hexyl-S'-propyl trithiocarbonate
S-allyl-S'-methyl trithiocarbonate
S-allyl-S'-n-butyl trithiocarbonate
S-allyl-S'-2-butenyl triothiocarbonate
S-allyl-S'-benzyl trithiocarbonate
S-benzyl-S'-2-butenyl trithiocarbonate
S,S'-diallyl trithiocarbonate
S,S'-diphenyl trithiocarbonate
S,S'-dicyclohexyl trithiocarbonate
S-cyclohexyl-S'-phenyl trithiocarbonate
S-n-butyl-S'-2-hexenyl trithiocarbonate
S-benzyl-S'-n-butyl trithiocarbonate and mixtures thereof. Hereinafter, the designation S and S' in the nomenclature is omitted for convenience, but is is understood that trithiocarbonates herein disclosed are those having the S— and S'— substitution. The presently preferred groups of trithiocarbonates are those wherein R is an alkenyl radical of 2–8 carbon atoms and R' is an alkyl or aralkyl radical of 2–8 carbon atoms.

The preparation of dihydrocarbyl trithiocarbonates is known in the art. One such preparation method is set forth in U.S. Pat. No. 2,574,829 in which S-alkali metal-S'-alkyl trithiocarbonates prepared from carbon disulfide, sodium hydroxide and an alkyl mercaptan is reacted with an organic halide. Another such method is set forth in U.S. Pat. No. 2,574,457 in which carbon disulfide and sodium hydroxide are reacted to give S,S'-disodio trithiocarbonate which in turn is reacted with a sulfenyl halide, RSX, to give the corresponding S,S'-disubstituted sulfenyl trithiocarbonate.

HYDROCARBON OILS

Hydrocarbon oils useful in this invention are those hydrocarbons having a specific gravity in the approximate range of 0.75 to 1.10 and a boiling point range generally between about 150° C. (302° F.) and 500° C. (932° F.), a typical boiling point range being 220° C. (initial boiling point) to 410° C. (95% point). An example for a hydrocarbon oil useful in accordance with this invention is kerosene. The preferred hydrocarbon oils are aromatic oils having an aromatic content of 50 weight % or more. Listed below are composition and properties of two typical aromatic oils, Aromatic Oil A having been employed in the flotation examples.

TABLE I

| Composition and Properties of Molybdenum Sulfide Collector Oils | Aromatic Oil A[a] | | Aromatic Oil B[b] | |
|---|---|---|---|---|
| | Vol. % | Wt. % (est.) | Vol. % | Wt. % (est.) |
| Saturates | 26.1 | 21.4 | 29.4 | 24.1 |
| Paraffins | 16.0 | 12.7 | 16.8 | 13.9 |
| Noncondensed Cycloparaffins | 5.7 | 4.7 | 6.7 | 5.6 |
| Condensed Cycloparaffins (2-rings) | 2.0 | 1.7 | 1.9 | 1.7 |
| Condensed Cycloparaffins (3-rings) | 2.4 | 2.2 | 4.0 | 3.8 |
| Aromatics | 73.9 | 78.6 | 70.6 | 75.9 |
| Mono | 11.3 | 10.3 | 13.8 | 12.9 |
| Benzenes | 4.2 | 3.7 | 5.1 | 4.5 |
| Naphthenebenzenes | 3.9 | 3.6 | 5.9 | 5.7 |
| Dinaphthenebenzenes | 3.2 | 3.0 | 2.8 | 2.7 |
| Di | 34.4 | 34.9 | 38.0 | 40.0 |
| Naphthalenes | 15.5 | 15.1 | 26.6 | 27.3 |
| Acenaphthenes, dibenzofuran | 11.3 | 11.6 | 6.0 | 6.6 |
| Fluorenes | 7.6 | 8.2 | 5.4 | 6.1 |
| Tri | 14.2 | 16.4 | 9.1 | 11.0 |
| Phenanthrenes | 12.2 | 14.0 | 8.5 | 10.3 |
| Naphthenephenanthrenes | 2.0 | 2.5 | 0.6 | 0.7 |
| Tetra | 4.4 | 5.6 | 2.8 | 3.6 |
| Pyrenes | 4.1 | 5.1 | 2.5 | 3.1 |
| Chrysenes | .4 | .5 | .4 | .5 |
| Penta | 0 | 0 | .1 | .1 |
| Perylenes | 0 | 0 | 0 | .1 |
| Dibenzanthracenes | 0 | 0 | 0 | 0 |
| Thiophenes | 9.6 | 11.3 | 6.9 | 8.3 |
| Benzothiophenes | 3.7 | 4.1 | 3.9 | 4.5 |
| Dibenzothiophenes | 5.7 | 7.1 | 2.9 | 3.7 |
| Molecular Weight | 218 | | 190 | |
| Refractive Index | 1.5982 | | 1.5604 | |
| Specific Gravity | 1.0110 | | 0.9587 | |

| Oil Boiling Range Data % Overhead | °C. | (F) | °C. | (°F.) |
|---|---|---|---|---|
| Initial BF | 238 | (462) | 217 | (424) |
| 2 | 286 | (548) | 235 | (455) |
| 5 | 303 | (578) | 242 | (469) |
| 10 | 318 | (605) | 251 | (484) |
| 20 | 331 | (628) | 263 | (506) |
| 30 | 343 | (649) | 274 | (526) |
| 40 | 351 | (664) | 285 | (546) |
| 50 | 359 | (679) | 297 | (567) |
| 60 | 371 | (699) | 312 | (593) |
| 70 | 379 | (715) | 329 | (624) |
| 80 | 388 | (731) | 349 | (661) |
| 90 | 419 | (786) | 372 | (701) |
| 95 | 427 | (800) | 399 | (750) |

[a]Aromatic $SO_2$ extract oil MC-Borger Unit 30 from Phillips Pertoleum Co.
[b]Widely used molybdenum collector Shell Aromatic 54 from Shell Chemical Co.

HYDROCARBYL SUBSTITUTED TRITHIOCARBONATE/AROMATIC OIL BLENDS

The volume ratio of hydrocarbyl substituted trithiocarbonate to aromatic oil useful in this invention is considered to be as follows:

| | Dihydrocarbyl Trithiocarbonate | Aromatic Oil |
|---|---|---|
| Broadly | 10–75 pts by vol | 90–25 pts by vol |
| Preferred | 45–55 pts by vol | 55–45 pts by vol |

In accordance with a second embodiment of this invention, an improved froth flotation process is provided. In this froth flotation process, a pulp is aerated to generate a froth containing the mineral and these minerals are recovered from this froth. Gangue materials are left behind. The process of this invention is characterized by using a flotation agent comprising an aromatic hydrocarbon oil as well as a dihydrocarbyl trithiocarbonate in the pulp as a flotation agent. This combined flotation agent has been found to enhance the mineral recovery, particularly when used in connection with copper and molybdenum containing ores. The specific disclosure concerning the aromatic oil and the dihydrocarbyl trithiocarbonate given above applies to this embodiment of the invention as well.

The flotation agent is preferably incorporated into the pulp in the form of a blend of the aromatic hydrocarbon oil and the dihydrocarbyl trithiocarbonate.

The amount of blend employed depends largely on the level of mineral in the ore. Generally, the blend concentration will be about 0.008 to 0.2 lbs of blend per ton of ore.

METAL-BEARING ORES

It is generally believed that the trithiocarbonate/aromatic oil blends disclosed herein are useful for separating a variety of metals from its corresponding gangue material. It is also understood that the blend may separate a mixture of metals that are contained in a particular mining deposit or ore, said mixture being further separated by subsequent froth flotations or any other conventional separating methods. The trithiocarbonate/aromatic oil blends herein disclosed are particularly useful for separating molybdenum minerals from the total ore. Examples of such molybdenum bearing ores are

| | |
|---|---|
| Molybdenite | $MoS_2$ |
| Wulfenite | $PbMoO_4$ |
| Powellite | $Ca(Mo,W)O_4$ |
| Ferrimolybdite | $Fe_2Mo_3O_{12} \cdot 8H_2O$ |

and mixtures thereof.

Other metal-bearing ores within the scope of this invention are, for example,

| | |
|---|---|
| Copper-Bearing Ores: | |
| Covallite | $CuS$ |
| Chalcocite | $Cu_2S$ |
| Chalcopyrite | $CuFeS_2$ |
| Bornite | $Cu_5FeS_4$ |
| Cubanite | $Cu_2SFe_4S_5$ |
| Valerite | $Cu_2Fe_4S_7$ or $Cu_3Fe_4S_7$ |
| Enargite | $Cu_3(As, Sb)S_4$ |
| Tetrahedrite | $Cu_3SbS_2$ |
| Tennanite | $Cu_{12}As_4S_{13}$ |
| Cuprite | $Cu_2O$ |
| Tenorite | $CuO$ |
| Malachite | $Cu_2(OH)_2CO_3$ |
| Azurite | $Cu_3(OH)_2CO_3$ |
| Antlerite | $Cu_3SO_4(OH)_4$ |
| Brochantile | $Cu_4(OH)_6SO_4$ |
| Atacamite | $Cu_2Cl(OH)_3$ |
| Chrysocolla | $CUSiO_8$ |
| Famatinite | $Cu_3(Sb, As)S_4$ |
| Bournonite | $PbCuSbS_3$ |
| Lead-Bearing Ore: | |
| Galena | $PbS$ |
| Antimony-Bearing Ore: | |
| Stibnite | $Sb_2S_3$ |
| Zinc-Bearing Ores: | |
| Sphalerite | $ZnS$ |
| Zincite | $ZnO$ |
| Smithsonite | $ZnCO_3$ |
| Silver-Bearing Ores: | |
| Argentite | $Ag_2S$ |
| Stephanite | $Ag_5SbS_4$ |
| Hessite | $AgTe_2$ |
| Chromium-Bearing Ores: | |
| Daubreelite | $FeSCr_2S_3$ |
| Chromite | $FeO \cdot Cr_2O_3$ |
| Gold-Bearing Ores: | |
| Sylvanite | $AuAgTe_2$ |
| Calaverite | $AuTe$ |
| Platinum-Bearing Ores: | |
| Cooperite | $Pt(AsS)_2$ |
| Sperrylite | $PtAs_2$ |
| Uranium-Bearing Ores: | |
| Pitchblende | $U_2O_5(U_3O_8)$ |
| Gummite | $UO_3 \cdot nH_2O$ |

and mixtures thereof.

SEPARATION CONDITIONS

Any froth flotation apparatus can be used in this invention. The most commonly used commercial flotation machines are the Agitar (Galigher Co.), Denver Sub-A (Denver Equipment Co.), and the Fagergren (Western Machinery Co.). A smaller laboratory scale apparatus such as the Hallimond Cell, Denver Cell-Model D-12, and the Wemco-2.5 liter Cell can also be used.

The instant invention was demonstrated in tests conducted at ambient room temperature and atmospheric pressure. However, any temperature or pressure generally employed by those skilled in the art is within the scope of this invention.

The following examples serve to illustrate the invention without undue limitation of its scope.

EXAMPLE 1

This example describes a control run wherein a fuel oil (kerosene) was used as a molybdenum sulfide collector. The example also describes the general procedure used to evaluate collectors disclosed herein. An ore (from Endako Mines Division, Placer Development Limited) containing about 0.130 wt. percent molybdenum or $MoS_2$ was ground to a-10 Tyler mesh size. The ground ore, 2087 grams, and water, 913 milliliters, were added to a ball mill (66.6 percent solids) followed by pine oil (8 drops from a No. 27 needle equal to 0.056 lbs/ton of ore), Syntex® (4 drops equal to 0.024 lbs/ton of ore) and kerosene fuel oil (23 drops, equal to 0.184 lbs/ton of ore). Syntex is a sulfonated coconut oil from Colgate-Palmolive. After 10.5 minutes grinding, the ore was washed into a Denver Flotation Cell, Model D-12. Sufficient water was added to bring the liquid level up to mark for 44 percent solids (2550 milliliters total water). The sample was conditioned for 2 minutes at 1400 rpm during which time the pH was adjusted to 7.5 with 10 percent sulfuric acid. The flotation time was 4 minutes. The rougher concentrate was filtered and dried at 110° C. in a forced-draft oven. The tails were coagulated by the addition of flocculant (Super-floc®16 from American Cyanamid), the excess water decanted, filtered, and oven dried. The rougher concentrate samples were ground in a Techmar Analytical Mill A-10 and analyzed for percent molybdenum. The tails were ground in a Microjet-2 Cross Beater Mill (5 liter), a representative sample removed and analyzed for molybdenum. The analysis can be found in Table II. Analysis of the concentrates and tails were performed by Emission Spectroscopy and on a Siemens X-ray fluorescense spectrograph.

TABLE II

Flotation of Molybdenum Sulfide
Using a Fuel Oil (Kerosene) Collector, 0.184 lbs/ton of Ore

| Run | Rougher Concentrate | | | Rougher Tails | | | % Mo |
|---|---|---|---|---|---|---|---|
| No. | Wt. g | % Mo | Mo, g | Wt. g. | % Mo | Mo, g | Recovered |
| 1 | 22.4 | 8.3 | 1.86 | 1984 | .023 | .456 | 80.3 |
| 2 | 31.1 | 6.2 | 1.93 | 1982 | .028 | .555 | 77.7 |
| 3 | 28.2 | 7.1 | 2.00 | 1982 | .024 | .476 | 80.8 |
| 4 | 32.3 | 6.2 | 2.00 | 1963 | .022 | .432 | 82.2 |
| | | | | | | Average | 80.3 |

EXAMPLE II

This example is a control run using a mostly aromatic oil as the $MoS_2$ collector. The procedure described in Example I was repeated except the kerosene fuel oil was replaced with a $SO_2$ extract oil available from Phillips Petroleum Co. (Borger Unit 30 Extract Oil, 73.9 volume percent aromatics, molecular weight 218, specific gravity 1.0110). The results listed in Table III indicate that aromatic oils are equal to kerosene in the amount of $MoS_2$ recovered.

TABLE III

Flotation of Molybdenum Sulfide Using an Aromatic Oil Collector, 0.184 lbs/ton of Ore

| Run | Rougher Concentrate | | | Rougher Tails | | | % Mo |
|---|---|---|---|---|---|---|---|
| No. | Wt. g | % Mo | Mo, g | Wt. g | % Mo | Mo, g | Re-covered |
| 1 | 33.7 | 5.1 | 1.72 | 1951 | .025 | .488 | 77.9 |
| 2 | 29.2 | 6.7 | 1.96 | 1942 | .025 | .486 | 80.1 |
| 3 | 54.5 | 3.9 | 2.13 | 2066 | .022 | .455 | 82.4 |
| | | | | | | Average | 80.1 |

EXAMPLE III

This example is a control run using a disubstituted trithiocarbonate as a $MoS_2$ collector. The procedure described in Example I was repeated except the kerosene fuel oil was replaced with 0.04 lbs/ton of ore of S-allyl-S'-n-butyl trithiocarbonate. The results listed in Table IV indicate the trithiocarbonate significantly increases the amount of $MoS_2$ recovered.

TABLE IV

Flotation of Molybdenum Sulfide Using S-Allyl-S'-n-Butyl Trithiocarbonate (0.04 lbs/ton of Ore) as Collector

| Run | Rougher Concentrate | | | Rougher Tails | | | % Mo |
|---|---|---|---|---|---|---|---|
| No. | Wt. g | % Mo | Mo, g | Wt. g | % Mo | Mo, g | Re-covered |
| 1 | 42.1 | 4.9 | 2.06 | 1960 | .020 | .392 | 84.0 |
| 2 | 30.9 | 6.5 | 2.01 | 2012 | .023 | .463 | 81.3 |
| 3 | 38.6 | 5.0 | 1.93 | 1969 | .021 | .413 | 82.4 |
| | | | | | | Average | 82.6 |

The S-allyl-S'-n-butyl trithiocarbonate has been prepared as follows:

150 Milliliters of distilled water and 44 grams (1.1 moles) of sodium hydroxide were added to a three-necked flask fitted with an addition funnel, stirrer and reflux condenser. After the base had dissolved and the solution cooled to about ambient room temperature, 90 grams (1.0 moles) of n-butyl mercaptan was added and the mixture was stirred for 1 hour at room temperature, whereupon 100 grams (1.33 moles) of carbon disulfide was added. The mixture was stirred for another hour. Within 1 hour 85 grams (1.1 moles) of allyl chloride was slowly added to this stirred mixture. The reaction was exothermic at this point. The mixture was stirred until the heat dissipated whereupon two liquid layers formed. The lower orange oily layer was separated, heated at 90°-100° C./17 mm Hg on a rotary evaporator to remove unreacted starting material to give 202 grams of product which was analyzed by Mass Spectroscopy and NMR and found to be consistent with the allyl n-butyl trithiocarbonate structure. In addition, elemental analysis for $C_8H_{14}S_3$ was:

| | Calculated | Found |
|---|---|---|
| % C | 46.55 | 46.20 |
| % H | 6.83 | 6.80 |
| % S | 46.61 | 49.0 |

EXAMPLE IV

This example is an inventive run illustrating that when an aromatic oil collector such as used in Example II and a trithiocarbonate collector such as used in Example III are blended, the blend gives a significant increase in the amount of $MoS_2$ recovered as compared to runs wherein each ingredient in the blend is employed separately. The procedure described in Example I was repeated except the kerosene fuel oil was replaced with a 50:50 vol. ratio blend of S-allyl-S'-n-butyl trithiocarbonate and aromatic oil (Unit 30). The results are listed in Table V and show an increase in $MoS_2$ removed as compared to when each ingredient of the blend is used separately (see Examples II and III).

TABLE V

Flotation of Molybdenum Sulfide Using a 50:50 Volume Blend of S-Allyl-S'-n-Butyl Trithiocarbonate and Aromatic Oil (0.182 lbs/ton of Ore)

| Run | Rougher Concentrate | | | Rougher Tails | | | % Mo |
|---|---|---|---|---|---|---|---|
| No. | Wt. g | % Mo | Mo, g | Wt. g | % Mo | Mo, g | Re-covered |
| 1 | 36.1 | 5.6 | 2.02 | 1926 | .020 | .385 | 84.0 |
| 2 | 41.9 | 4.8 | 2.01 | 1985 | .019 | .377 | 84.2 |
| | | | | | | Average | 84.1 |

EXAMPLE V

This example is an inventive run and illustrates the effectiveness of the blend described in Example IV in recovering molybdenum from other type ores. The results listed in Table VI show how the blend increases the % Mo recovered as compared to other collectors used. The examples previously described (I, II, III and IV) were essentially repeated except the ore employed contained about 0.55 wt. percent copper mineral and about 0.015 wt. percent molybdenum mineral (Cities Service Pinto Valley Mine ore, Miami, Arizona). In addition, a Wemco 2.5 liter Flotation Cell was used instead of a Denver Cell.

TABLE VI

Flotation of Molybdenum Sulfide Using Various Collectors and a Cities Service Pinto Valley Mine Ore

| Collector | Run No. | Rougher Concentrate Wt. g | % Mo | Mo, g | Rougher Tails Wt. g | % Mo | Mo, g | % Mo Recovery |
|---|---|---|---|---|---|---|---|---|
| A. Kerosene Fuel Oil .01 lbs/ton Ore | 1 | 47.4 | .086 | .041 | 872 | .0057 | .05 | 45.1 |
| | 2 | 62.5 | .061 | .038 | 846 | .0041 | .035 | 54.1 |
| | 3 | 60.5 | .070 | .042 | 847 | .0067 | .057 | 42.4 |
| | 4 | 50.7 | .062 | .031 | 816 | .0063 | .051 | 37.8 |
| | | | | | | | Average | 44.4 |
| B. Aromatic Oil[a] .013 lbs/ton Ore | 1 | 40.6 | .085 | .035 | 868 | .005 | .043 | 44.3 |
| | 2 | 46.2 | .116 | .054 | 866 | .0041 | .036 | 60.0 |
| | 3 | 57.6 | .077 | .040 | 803 | .0052 | .042 | 48.8 |
| | 4 | 76.6 | .089 | .068 | 797 | .0035 | .028 | 70.8 |
| | | | | | | | Average | 55.9 |
| C. Trithiocarbonate Ester[b], .018 lbs/ | 1 | 58.5 | .096 | .056 | 854 | .0039 | .033 | 63.0 |
| | 2 | 33.5 | .139 | .047 | 885 | .0044 | .039 | 54.7 |

TABLE VI-continued

| Collector | Run No. | Rougher Concentrate Wt. g | Rougher Concentrate % Mo | Rougher Concentrate Mo, g | Rougher Tails Wt. g | Rougher Tails % Mo | Rougher Tails Mo, g | % Mo Recovery |
|---|---|---|---|---|---|---|---|---|
| ton Ore | 3 | 28.9 | .193 | .055 | 883 | .0039 | .034 | 61.8 |
| | | | | | | | Average | 59.8 |
| D. Inventive Blend[c] | 1 | 28.1 | .174 | .049 | 889 | .0037 | .033 | 59.8 |
| .016 lbs/ton Ore | 2 | 29.1 | .177 | .052 | 880 | .0035 | .031 | 62.7 |
| | | | | | | | Average | 61.3 |

Flotation of Molybdenum Sulfide Using Various Collectors and a Cities Service Pinto Valley Mine Ore

[a]Aromatic $SO_2$ extract oil from Phillips Petroleum Co., Unit 30-Borger.
[b]Same as used in example 3.
[c]Same as used in example 4.

SUMMARY

The data herein disclosed is summarized in Table VII wherein it is shown that the inventive blend increases the amount of molybdenum recovered as compared to when the ingredients are employed separately as collectors.

TABLE VII

Summary-Flotation of Molybdenum Sulfide

| Example No. | Collector | Amt of Collector lbs/ton of Ore | % Molybdenum Recovered Ore A[a] | % Molybdenum Recovered Ore B[b] |
|---|---|---|---|---|
| I | Kerosene Fuel Oil | .184 | 80.3 | — |
| II | Aromatic Extract Oil[c] | .184 | 80.1 | — |
| III | Disubstituted Trithiocarbonate | .040 | 82.6 | — |
| IV | Invention: 50:50 wt. Blend of Aromatic Extract Oil and Disubstituted Trithiocarbonate | .182 | 84.1 | — |
| $V_1$ | Kerosene Fuel Oil | .010 | — | 44.4 |
| $V_2$ | Aromatic Extract Oil | .013 | — | 55.9 |
| $V_3$ | Disubstituted Trithiocarbonate | .018 | — | 59.8 |
| $V_4$ | Invention: 50:50 wt. Blend of Aromatic Extract Oil and Disubstituted Trithiocarbonate | .016 | — | 61.3 |

[a]Contains about .13 wt % molybdenum. Available from Endako Mines Div. of Placer Development Limited, Endako, B.C. Canada.
[b]Contains about .015 wt. % molybdenum. Available from Cities Service Pinto Valley Mine, Miami, Arizona.
[c]Borger Texas $SO_2$ extract oil. MC Aromatic, Phillips Petroleum Co.

Reasonable variations and modifications which will become apparent to those skilled in the art can be made in this invention without departing from the spirit and scope thereof.

I claim:

1. In a froth flotation process wherein a pulp of ore and water is aerated to generate a minerals containing froth and wherein said minerals are recovered from said froth, the improvement comprising incorporating into said pulp prior to said aeration a flotation agent comprising An aromatic oil having a specific gravity in the range of about 0.75 to 1.10 and a boiling point in the range of about 150° C. to 500° C. and an aromatic content of about 50 weight percent or more and (b) a dihydrocarbyl trithiocarbonate having the formula $$R-S-\overset{\overset{\displaystyle S}{\|}}{C}-S-R'$$

wherein R is allyl and R' is n-butyl.

2. A process in accordance with claim 1 wherein said flotation agent is employed in a quantity of 0.008 to 0.2 lbs of flotation agent per ton of mineral ore present in said pulp.

3. A process in accordance with claim 1 wherein said flotation agent comprises 10 to 75 volume parts of aromatic oil and 90 to 25 volume parts of said dihydrocarbyl trithiocarbonate.

4. A froth flotation process comprising (a) wet grinding crushed ore to form a pulp, (b) adding a flotation agent comprising (aa) An aromatic oil having a specific gravity in the range of about 0.75 to 1.10 and a boiling point in the range of about 150° C. to 500° C. and an aromatic content of about 50 weight percent or more and (bb) a dihydrocarbyl trithiocarbonate having the formula $$R-S-\overset{\overset{\displaystyle S}{\|}}{C}-S-R'$$

wherein R is an alkenyl radical of 2–8 carbon atoms and R' is an alkyl or aralkyl radical of 2–8 carbon atoms to said pulp, (c) pumping air into said pulp to froth said pulp, (d) removing froth from said pulp, and (e) recovering minerals from said froth.

5. A process in accordance with claim 4 wherein said flotation agent comprises 10 to 75 parts by volume of said aromatic oil and 90 to 25 parts by volume of said dihydrocarbyl trithiocarbonate.

6. A process in accordance with claim 4 wherein said flotation agent is employed in a quantity of 0.008 to 0.2 lbs of flotation agent per ton of mineral ores.

7. A process in accordance with claim 4 wherein said ore is a molybdenum containing ore and wherein said froth contains molybdenum minerals.

8. A flotation agent comprising:

(a) 10 to 75 parts by volume of an aromatic oil having a specific gravity in the range of about 0.75 to 1.10 and a boiling point in the range of about 150° C. to 500° C. and an aromatic content of about 50 weight percent or more, and (b) 90 to 25 parts by volume of S-allyl-S'-n-butyl trithiocarbonate.

* * * * *

UNITED STATES PATENT AND TRADEMARK OFFICE

CERTIFICATE OF CORRECTION

PATENT NO. : 4,316,797

DATED : February 23, 1982

INVENTOR(S) : Robert M. Parlman

It is certified that error appears in the above-identified patent and that said Letters Patent are hereby corrected as shown below:

Column, 9, claim 1, line 54, before "An" insert --- (a) ---.

Signed and Sealed this

*Eighteenth* Day of *May 1982*

[SEAL]

*Attest:*

GERALD J. MOSSINGHOFF

*Attesting Officer*

*Commissioner of Patents and Trademarks*